US005463256A

United States Patent [19]

Wang et al.

[11] Patent Number: 5,463,256

[45] Date of Patent: Oct. 31, 1995

[54] FEEDER USED WITH SCANNER

[75] Inventors: Oliver Wang; Ben Hou, both of Taipei Hsien, Taiwan

[73] Assignee: Primax Electronics Ltd., Taipei Hsien, Taiwan

[21] Appl. No.: 250,479

[22] Filed: May 27, 1994

[51] Int. Cl.[6] ..... B65H 5/06

[52] U.S. Cl. ..... 271/274; 271/273

[58] Field of Search ..... 271/272, 273, 271/274

[56] References Cited

U.S. PATENT DOCUMENTS

| | | | |
|---|---|---|---|
| 4,457,507 | 7/1984 | Ishikawa et al. | 271/171 X |
| 4,461,212 | 7/1984 | Geney | 271/274 X |
| 4,482,148 | 11/1984 | Stewart, Jr. | 271/274 X |
| 5,172,900 | 12/1992 | Uno et al. | 271/274 X |
| 5,199,702 | 4/1993 | Davis et al. | 271/272 X |

*Primary Examiner*—H. Grant Skaggs

*Assistant Examiner*—Carol L. Druzbick

*Attorney, Agent, or Firm*—Knobbe, Martens, Olson & Bear

[57] ABSTRACT

The present invention relating to a feeder adapted to be used with a scanner for feeding for the scanner an article comprises a shell adapted to mount therewith the scanner, a driving device for feeding for the scanner the article, an adjusting device contained in the shell to adjust a height of a passage through which the article can pass to be scanned by the scanner according to a thickness of the article, and a floating box contained in the shell and mounting therein the driving device. The present invention mounts the motor, the driving device and the group of gears together in a floating box which further cooperates with a shell to form the present feeder has at least the following advantages that a performance test can be proceeded before the whole feeder is set up completely, that because the floating box and the shell are separately manufactured, the whole feeder structure need not be scrapped in case of a little defect in each of the two parts, and that the floating box can cost-effectively cooperate with different kinds of shells favored by different countries.

21 Claims, 3 Drawing Sheets

FEEDER USED WITH SCANNER

FIELD OF THE INVENTION

The present invention is related to a feeder used with a scanner, and more precisely to a feeder which can adjust the height of a passage through which an article can pass to be scanned by the scanner according to the thickness of the scanned article.

BACKGROUND OF THE INVENTION

Due to the rapid development of information industries, the kinds of peripheral devices therefore increase. Scanners, owing to their low price and convenience, are favored by PC users.

Generally speaking, the way a hand-held scanner is used is to move the scanner with hand on a scanned article. When the scanner smoothly passes through the article from one end to the other, a scanning operation is achieved. However, when the scanner is not moved under a certain condition, such as a constant scanning direction or an almost steady scanning speed, the quality of the scanning is affected. For example, if the direction of the scanning is slanted, the scanning result will possibly be distorted; and if the velocity is not accurately controlled, a line-drop situation will possibly occur.

In order to improve the scanning quality, a first kind of feeder used with a scanner was offered. This kind of feeder mounts therein two driven rollers and the scanner mounts therein two rollers, two springs and a motor. When the two rollers mounted in the bottom of the scanner are driven by the motor, the two driven rollers of the feeder are driven. Thus the scanned article can pass through the passage between the scanner rollers and the driven rollers. The function of the two springs urging respectively against the two scanner rollers is to adjust the distance between the scanner rollers and the driven rollers and assure that the scanned article thicker or thinner than the passage is fed successfully.

Although this kind of feeder allows articles of various thicknesses to be fed, it can be used only with a scanner with driving elements including the motor and scanner rollers. However, most of the early scanners have no driving element therein, and therefore this kind of feeder cannot satisfy the user having only an early scanner.

A second kind of feeder was therefore offered. A motor, driving rollers, driving belts and gears, and springs are mounted directly in a shell of this kind of feeder. The motor is used to drive the driving rollers by the aid of the driving belts and gears. The springs are used to adjust the distance between the rollers and the driven rollers and assure that the scanned article thicker or thinner than the passage is fed successfully.

Although this kind of feeder can be used with a scanner without a driving element therein, that the driving elements of this kind of feeder are directly mounted in the shell makes the mould for molding this kind of feeder and thus the feeder structure more complicated, which assumes a risk of scrapping the whole feeder if any part of the feeder structure has a little defect. Besides, that a performance test may proceed only after the whole feeder is set up completely results in the inflexibility of the working procedure. Furthermore, due to various aesthetic senses recognized in different countries, the shells are often required to have various appearances. If the driving elements are to be manufactured together with the various kinds of shells of various appearances, various kinds of complicated feeder moulds are needed and thus the cost spent for various feeder moulds is too much.

SUMMARY OF THE INVENTION

An object of the present invention is to offer a feeder used with a scanner, wherein a driving device and a motor is mounted in a floating box which is to be incorporated with a shell, to reduce possible waste of the cost owing to a part defect upon manufacturing the feeder.

Another object of the present invention is to offer a feeder used with a scanner to achieve the purpose of cost-effectively changing a shell. Another object of the present invention is to offer a feeder used with a scanner to make the working procedure more flexible.

Another object of the present invention is to offer a feeder used with a scanner to feed an article for the scanner in a constant direction. In accordance with the present invention, a feeder adapted to be used with a scanner for feeding for the scanner an article comprises a shell adapted to mount therewith the scanner, a driving device for feeding for the scanner the article, an adjusting device contained in the shell to adjust a height of a passage through which the article can pass to be scanned by the scanner according to a thickness of the article, and a floating box contained in the shell and mounting therein the driving device. In accordance with another aspect of the present invention, the driving device feeds the article by a frictional force.

In accordance with another aspect of the present invention, the passage is formed in the feeder.

In accordance with another aspect of the present invention, the scanner includes a roller with which the driving device cooperates to feed the article.

In accordance with another aspect of the present invention, the passage is formed between the feeder and the scanner.

In accordance with another aspect of the present invention, the adjusting device is used to adjust a distance between the driving device and the scanner roller.

In accordance with another aspect of the present invention, the driving device includes a first and a second driving rollers.

In accordance with another aspect of the present invention, the adjusting device includes a first and a second adjusters for respectively urging the driving rollers against the article.

In accordance with another aspect of the present invention, the driving rollers are spaced in parallel.

In accordance with another aspect of the present invention, the adjusting device is a spring.

In accordance with another aspect of the present invention, the feeder further comprises a motor contained m the floating box for driving the driving device.

In accordance with another aspect of the present invention, the feeder further comprises a flat stand set up on the shell and near the first driving roller for putting the article thereon.

In accordance with another aspect of the present invention, the feeder further comprises two adjusting boards for regulating the article on the plat stand and changing a distance therebetween according to a size of the article.

In accordance with another aspect of the present invention, the size of the article is about $3\times5$ in$^2$, bigger than about 3 inches×5 inches or smaller than about 3 inches×5 inches.

In accordance with another aspect of the present invention, the adjusting device is a spring.

In accordance with another aspect of the present invention, the feeder further comprises a motor contained in the floating box for driving the driving device.

In accordance with another aspect of the present invention, the shell includes an upper shell and a lower shell.

In accordance with another aspect of the present invention, the article is a paper document, a card or a photograph.

In accordance with another aspect of the present invention, the scanner is a hand-held scanner.

The present invention may be best understood through the following description with reference to the accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
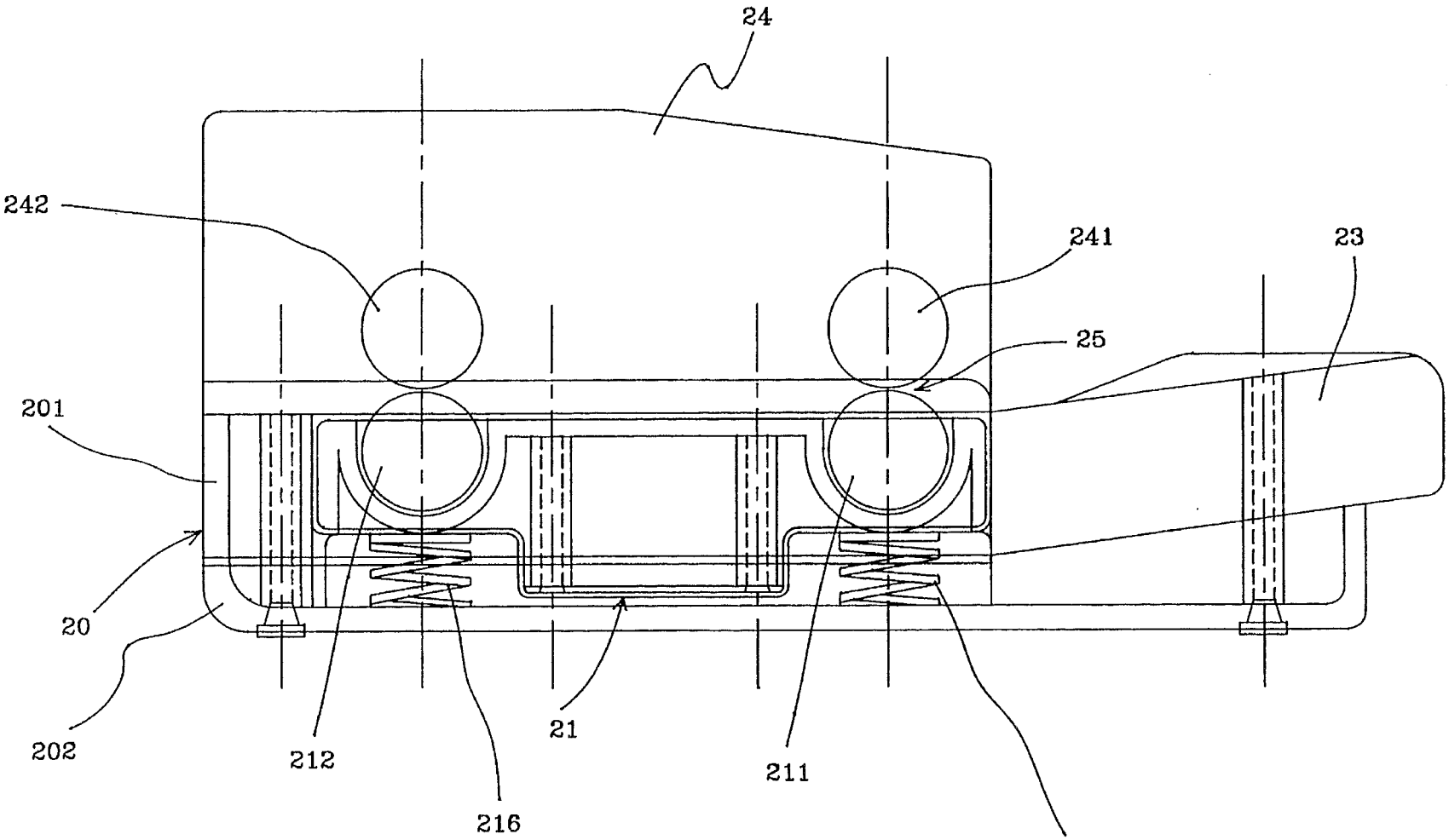
FIG. 1 is a schematically structural side view of a preferred embodiment of a feeder used with a scanner according to the present invention.
Figure 2:
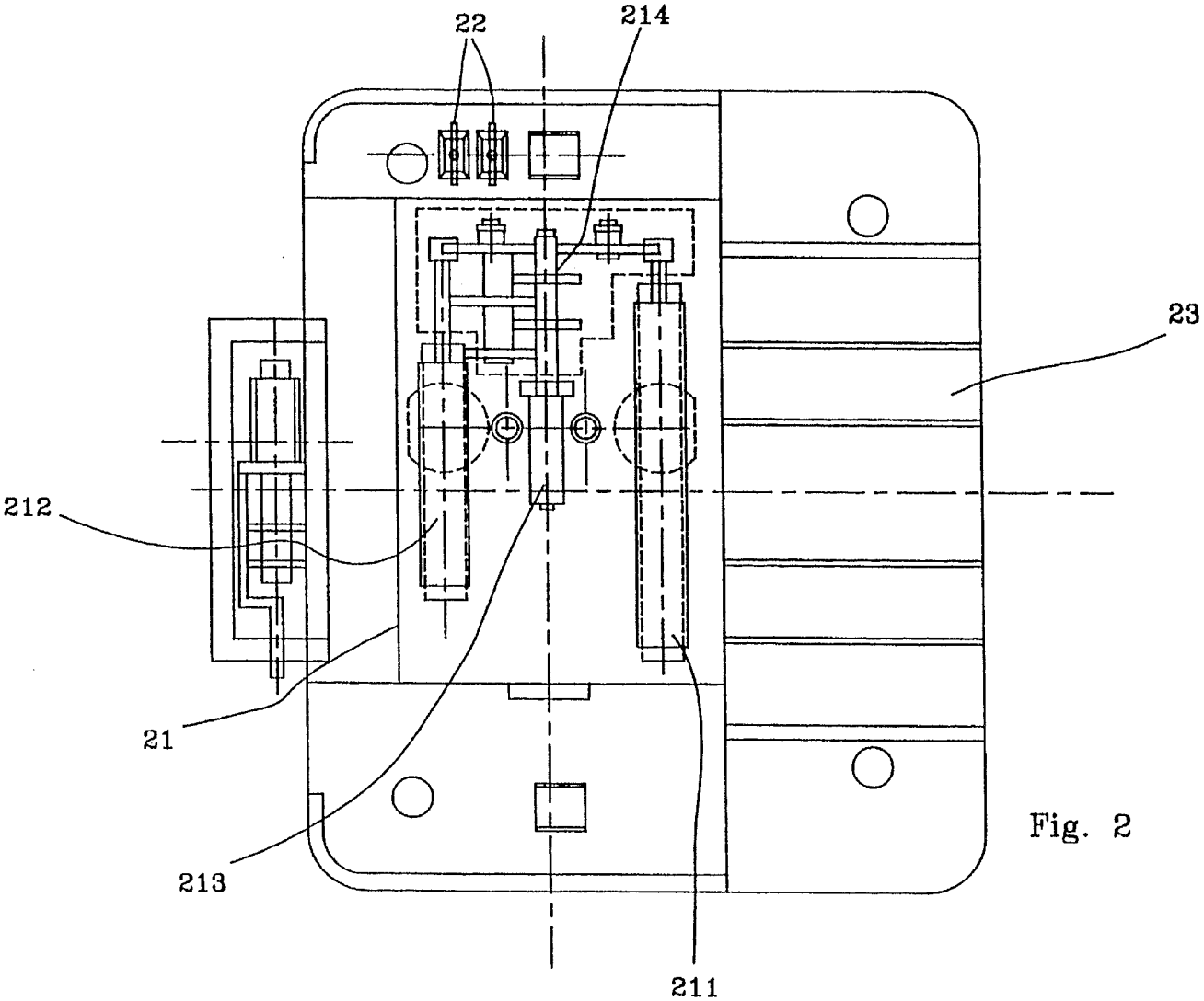
FIG. 2 is a schematically structural top view of a preferred embodiment of a feeder used with a scanner according to the present invention.

Now refer to FIGS. 1 and 2 which are schematically structural side and top views, respectively, of a preferred embodiment of a feeder used with a scanner according to the present invention. In this preferred embodiment, the present invention comprises a shell 20 which includes an upper shell 201 and a lower one 202, a floating box 21, an adjusting device which includes two adjusters 215 and 216, a power connector 22 and a flat stand 23. The floating box 21 is mounted in the shell 20 and mounts therein but slightly protrudes therefrom a driving device including two driving rollers 211 and 212, a motor 213, and a group of gears 214. The two adjusters 215 and 216 are springs in this case. The feeder further comprises two adjusting boards 231 mounted on and perpendicular to the flat stand 23. The scanner 24 includes two rollers 241 and 242. There is a passage 25 existing between the present feeder and the scanner 24.

Figure 3:
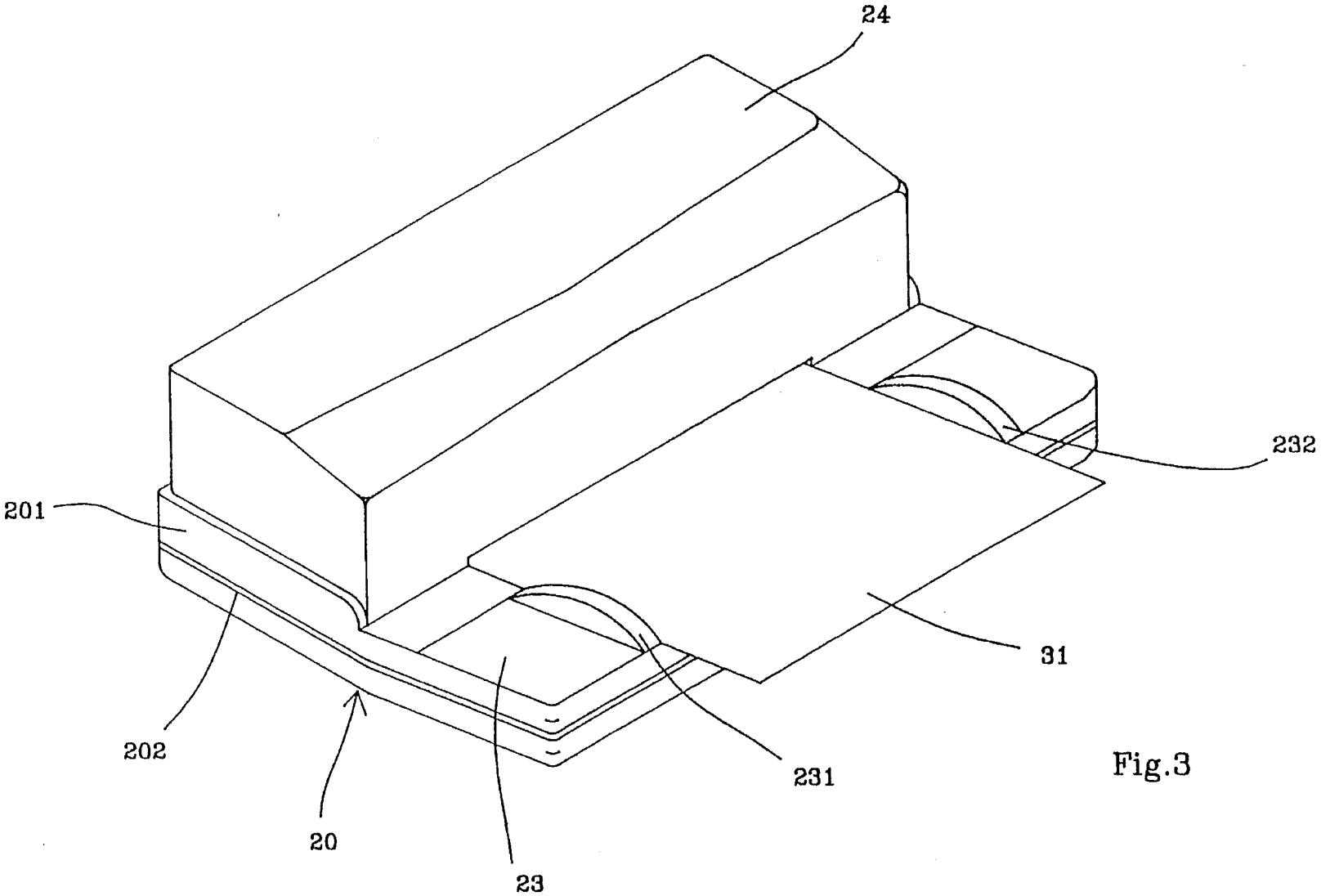
FIG. 3 is a perspective view showing an operation of a preferred embodiment of a feeder used with a scanner according to the present invention.

A scanned document 31 is placed on the flat stand 23 to fix the direction which the document 31 is to pass through the scanner 24, as shown in FIG. 3, and the adjusting boards 231 are adjusted to fit the size of the document 31. When the scanner 24 is powered on, the motor 213 obtains power from the scanner 24 through a power connector 22 to drive the driving rollers 211 and 212. In order to prevent the motor 213 from rotating too fast and affecting the feeding speed, the group of gears 214 is used to control the rotating speed of the driving rollers 211 and 212 at a proper one. Before the scanning begins, the document 31 is placed on the flat stand 23 and an end of the document 23 is put in a passage 25 between the driving roller 211 and the roller 241. When the scanning begins, the document 31 passes through the scanner 24, relying on the frictional force occurred among the document 31, the driving roller 211 and the roller 241. The existence of the driving roller 212 and the roller 242 helps the document 31 to be transmitted stably. By this way, a desired scanning is achieved During the scanning operation, the springs 215 and 216 adjust the distance between the driving roller 211 and the roller 241, and the distance between the driving roller 212 and the roller 242, respectively. When there is no article entering the feeder, the springs 215 and 216 urging against the driving rollers 211 and 212 make the driving rollers 211 and 212 contact with the rollers 241 and 242, respectively. When the document 31 enters the passage 25 between the driving roller 211 and the roller 241, the springs 215 and 216 will be compressed to a degree allowing the document 31 to be successfully fed according to the thickness of the document 31. Thus the failure of scanning caused by the improper thickness of scanned article is overcome.

To sum up, the present invention mounts the motor, the driving device and the group of gears together in a floating box which further cooperates with a shell to form the present feeder has several advantages that:

1. The main elements are installed in a floating box, so a performance test can be proceeded before the whole feeder is set up completely.
2. Because the floating box and the shell are separately manufactured, the whole feeder won't be scrapped in case of a little defect in each of the two parts.
3. The floating box can cooperate with different kinds of shells favored by different countries, and the present invention avoids the shortcomings of needing various kinds of complicated moulds and costing more in obtaining feeders of various outer shapes.

Moreover, the mounting of the flat stand avoids the inconvenience caused by supporting the document by hand, and also keeps the feeding direction of the scanned article unchanged to avoid scanning distortion.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures.

What we claim is:

1. A detachable feeder adapted to be used with a scanner for feeding an article to said scanner, comprising:

a shell adapted to detachably mount to said scanner;

a floating box contained in said shell;

a driving device mounted substantially within said floating box for feeding said article to said scanner; and an adjusting device contained in said shell to adjust a location of said floating box in order to control a height of a passage through which said article can pass to be scanned by said scanner according to a thickness of said article.

2. A feeder according to claim 1, wherein said driving device feeds said article by a frictional force.

3. A feeder according to claim 1, wherein said passage is formed in said feeder.

4. A feeder according to claim 1, wherein said scanner includes a roller with which said driving device cooperates to feed said article.

5. A feeder according to claim 4, wherein said passage is formed between said feeder and said scanner.

6. A feeder according to claim 5, wherein said adjusting device is used to adjust a distance between said driving device and said scanner roller.

7. A feeder according to claim 1, wherein said driving device includes a first and a second driving rollers.

8. A feeder according to claim 7, wherein said adjusting device includes a first and a second adjusters for respectively urging said driving rollers against said article.

9. A feeder according to claim 7, wherein said driving rollers are spaced in parallel.

10. A feeder according to claim 7, further comprising a flat stand set up on said shell and near said first driving roller for putting said article thereon.

11. A feeder according to claim 10, further comprising two adjusting boards for regulating said article on said flat stand and changing a distance therebetween according to a size of said article.

12. A feeder according to claim 11, wherein said size of said article is about 3×5 $in^2$.

13. A feeder according to claim 11, wherein said size of said article is bigger than about 3 inches×5 inches.

14. A feeder according to claim 11, wherein said size of said article is smaller than about 3 inches×5 inches.

15. A feeder according to claim 1, wherein said article is a paper document.

16. A feeder according to claim 1, wherein said adjusting device is a spring.

17. A feeder according to claim 1, further comprising a motor contained in said floating box for driving said driving device.

18. A feeder according to claim 1, wherein said shell includes an upper shell and a lower shell.

19. A feeder according to claim 1, wherein said article is a photograph.

20. A feeder according to claim 1, wherein said article is a card.

21. A feeder according to claim 1, wherein said scanner is a hand-held scanner.

* * * * *